US005299861A

United States Patent [19]

Foliot et al.

[11] Patent Number: 5,299,861

[45] Date of Patent: Apr. 5, 1994

[54] SCHOOL DESK HAVING METAL BASE AND WOOD TOP

[75] Inventors: Daniel Foliot, 36, rue Filion, Saint-Sauveur-des-Monts, Québec, Canada, J0R 1R0; James Anglehart, Montréal, Canada

[73] Assignee: Daniel Foliot, Saint-Sauveur-des-Monts, Canada

[21] Appl. No.: 893,792

[22] Filed: Jun. 4, 1992

[51] Int. Cl.[5] ..... A47B 17/00

[52] U.S. Cl. ..... 312/194; 312/313; 108/25

[58] Field of Search ..... 312/194, 290, 328, 313, 312/315, 195; 108/25, 33, 36, 111

[56] References Cited

U.S. PATENT DOCUMENTS

| | | | |
|---|---|---|---|
| 1,840,274 | 1/1932 | Merrill | 312/313 |
| 1,920,452 | 8/1933 | Wagner | 312/313 |
| 2,006,603 | 7/1935 | Nordmark | 312/313 |
| 2,469,239 | 5/1949 | Nordmark | 312/313 |
| 2,671,002 | 3/1954 | White | 108/25 |
| 4,437,411 | 3/1984 | Maxwell | 312/194 |
| 5,107,775 | 4/1992 | Langlais | 108/144 |

FOREIGN PATENT DOCUMENTS

| | | | |
|---|---|---|---|
| 655167 | 3/1965 | Belgium | 312/194 |
| 1477927 | 4/1966 | France | 312/194 |
| 465169 | 12/1968 | Switzerland | 312/194 |

*Primary Examiner*—Flemming Saether
*Attorney, Agent, or Firm*—ROBIC

[57] ABSTRACT

The desk comprises a metal base including leg attachment means and a sheet, the sheet providing a bottom of a storage compartment of the desk, two wood side panels having upper, lower, rear and front edges, the lower edge resting on and being protected by said sheet, the side members being connected to said base, a front panel member connected to said base and covering said front edges of the two wood side members, a rear panel member connected to said base and covering said rear edges of the two wood side members, and a top cover member hingedly connected to said rear member for covering said storage compartment formed by said sheet and said side, front and rear panels. The special construction reduces finishing costs for the wood and metal desk.

8 Claims, 3 Drawing Sheets

SCHOOL DESK HAVING METAL BASE AND WOOD TOP

FIELD OF THE INVENTION

The present invention relates to a desk construction having a metal base and a wood top.

BACKGROUND OF THE INVENTION

School desks have traditionally been made of wood, and sometimes with metal bases which are either freely positionable on or fixed to the classroom floor. It is also known to make school desks which are entirely made of metal except for the writing surface.

For aesthetic reasons, wood desks are more desirable. However, the labor costs associated with the metal work required to build desks from metal are less than a wooden construction. It is less expensive to braze metal parts than to join wood parts together. Therefore, it is hard for a wood desk to compete with a metal desk for price, and the school boards purchasing large quantities of desks cannot justify a significantly greater expenditure for the sake of aesthetics.

Two factors make wood construction more expensive than metal. The first is joining parts together, and the second is edge banding (finishing). In a hybrid metal and wood construction, some joining can be reduced by fixing wood parts to metal ones, however, edge finishing remains a problem.

SUMMARY OF THE INVENTION

It is therefore an object of the invention to provide a metal and wood desk construction which reduces the cost of edge banding or finishing, while maintaining a predominant visual appearance of a wood construction desk top or upper part.

According to the invention, there is provided a desk comprising a metal base including leg attachment means and a sheet, the sheet providing a bottom of a storage compartment of the desk, two wood side panels having upper, lower, rear and front edges, the lower edge resting on and being protected by the sheet, the side members being connected to the base, a front panel member connected to the base and the two wood side members, a rear panel member connected to the base and the two wood side members, and a top cover member hingedly connected to the rear member for covering the storage compartment formed by the sheet and the side, front and rear panels.

Preferably, the rear and front panel members may be made of wood. The side, front and rear panel members may be made of laminated particle board. The two wood side panel members may be provided with laminate on their exterior sides and on their upper edges, and the front and rear panel members may be provided with laminate on their exterior side surfaces as well as their side edges. The front or the rear edges of the two side members may be covered by the front or rear panel members respectively. The upper edge of the front wood panel member may be covered by a pencil trough.

Preferably, the rear panel member may also be formed by bending an extension of the base upwardly and would be made of metal instead of wood.

BRIEF DESCRIPTION OF THE DRAWINGS

The invention will be better understood by way of the following description of a preferred embodiment with reference to the drawings, in which.

DETAILED DESCRIPTION OF THE PREFERRED EMBODIMENT

Figure 1:
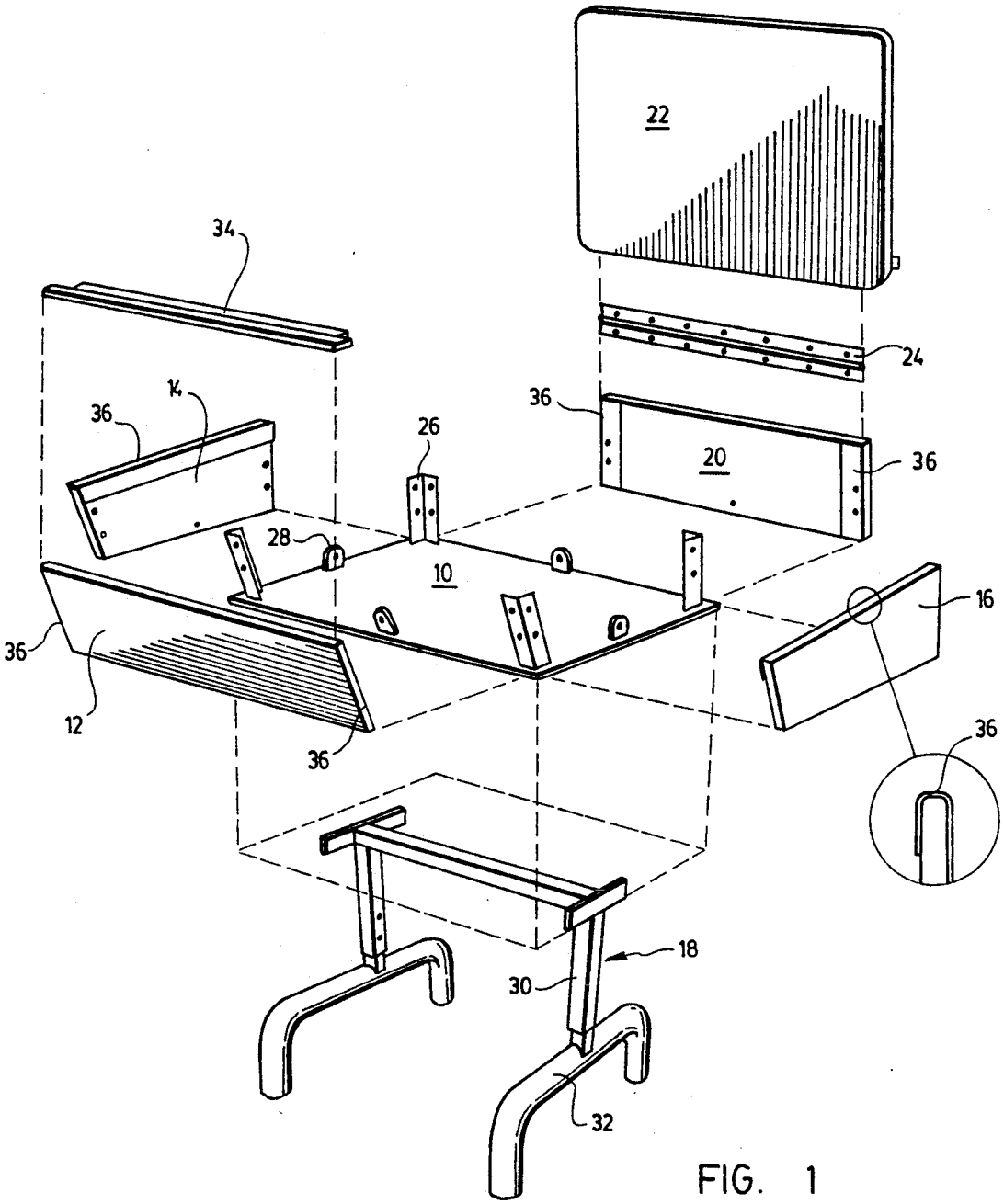
FIG. 1 is an exploded view of the preferred embodiment.
Figure 2:
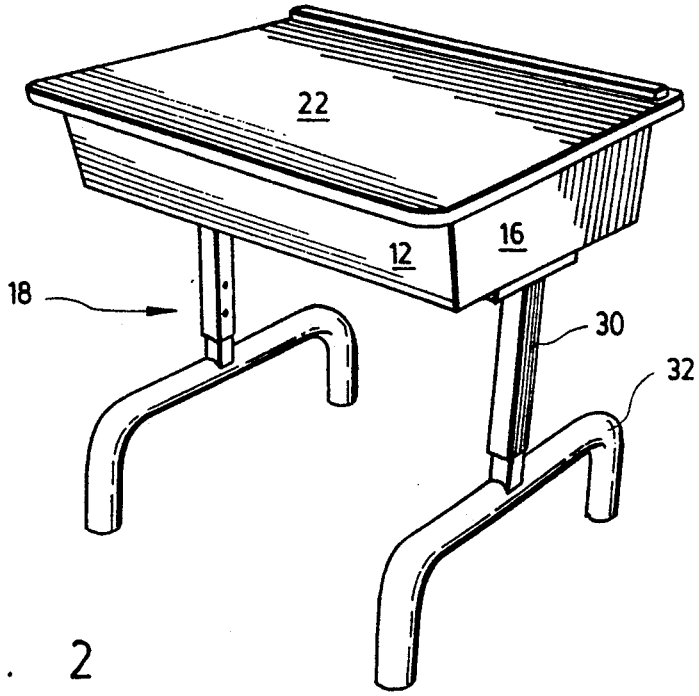
FIG. 2 is a perspective view of the preferred embodiment.
Figure 3:
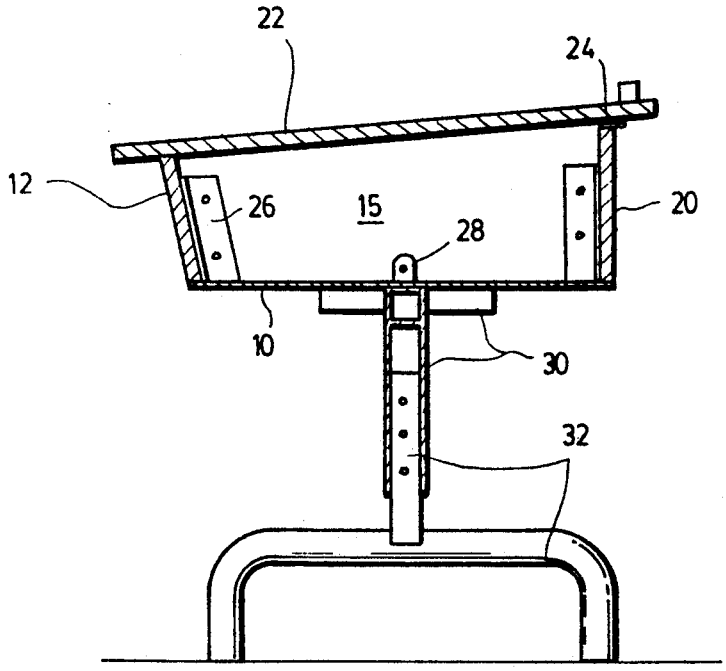
FIG. 3 is a side cross section of the preferred embodiment.

In the preferred embodiment shown in FIGS. 1 to 3, the school desk has a metal base sheet (10) to which leg attachment member (30) is spot welded. Member (30) also includes a cross piece which reinforces base sheet (10), and has two leg receiving sockets for receiving leg members (32). The base (18) includes the socket attachment members (30) and legs (32). Legs (32) are adjustable in height in members (30), but could also be fixed to sheet (10). The sheet (10) is provided with corner brackets (26) to which panel members (12), (14), (16) and (20) are fastened. Tabs (28) also serve as anchoring points to fasten the panels to the base (10). Writing surface or top cover member (22) is hingedly attached to rear panel member (20) by means of hinge (24). A pencil trough (34) is fixed to the top edge of front panel (12). The construction provides a storage compartment (15).

In the preferred embodiment, panels (12), (14), (16) and (20) are wood panels made of particle board. Particle board (even more than wood planks) requires edge finishing or banding to look good, be safe and prevent deterioration. Therefore, edges (36) are protected by edge banding. These edges (36) can be edge banded on larger pieces of wood, and then the larger pieces can be cut to size to make the panels. The edge banding may be a glued strip of laminate on the edges (36) alone, part of a laminate coating on the panels, or a special resin/paint coating on the edges (36). The cut edges of the panels will be covered according to the invention by the adjacent panel members and the base sheet (10), or in the case of the front member the pencil trough will cover its upper edge.

The base sheet (10) not only covers the bottom edges of the panels, but it also prevents chipping of the bottom edges by providing a hard and durable metal boarder. The edges of the sheet (10) are suitably rounded for safety. The side cut edges of the side panels (14) and (16) are covered by the front and rear panels (12) and (20). The top cut edge of the front panel (12) is covered by the wood pencil trough (it could also be made of plastic), and the cut top edge of the rear panel member (20) need not be covered by an edge band, since it is usually covered by top cover (22) or hinge (24).

In the construction shown, there is no finishing work to be done once the component elements are made. Sheet (10) is prepared by rounding its edges and then by welding brackets (26), tabs (28) and member (30) thereto. Wood screws or the like are then used to fasten the panels to the base sheet (10), pencil trough (34) is fixed to the front panel (12), hinge (24) is fastened to cover (22) and to the base, and finally the leg members (32) are inserted into base members (30). All cut edges are covered and protected without additional labor, and the appearance of a mostly wood construction is produced.

Figure 4:
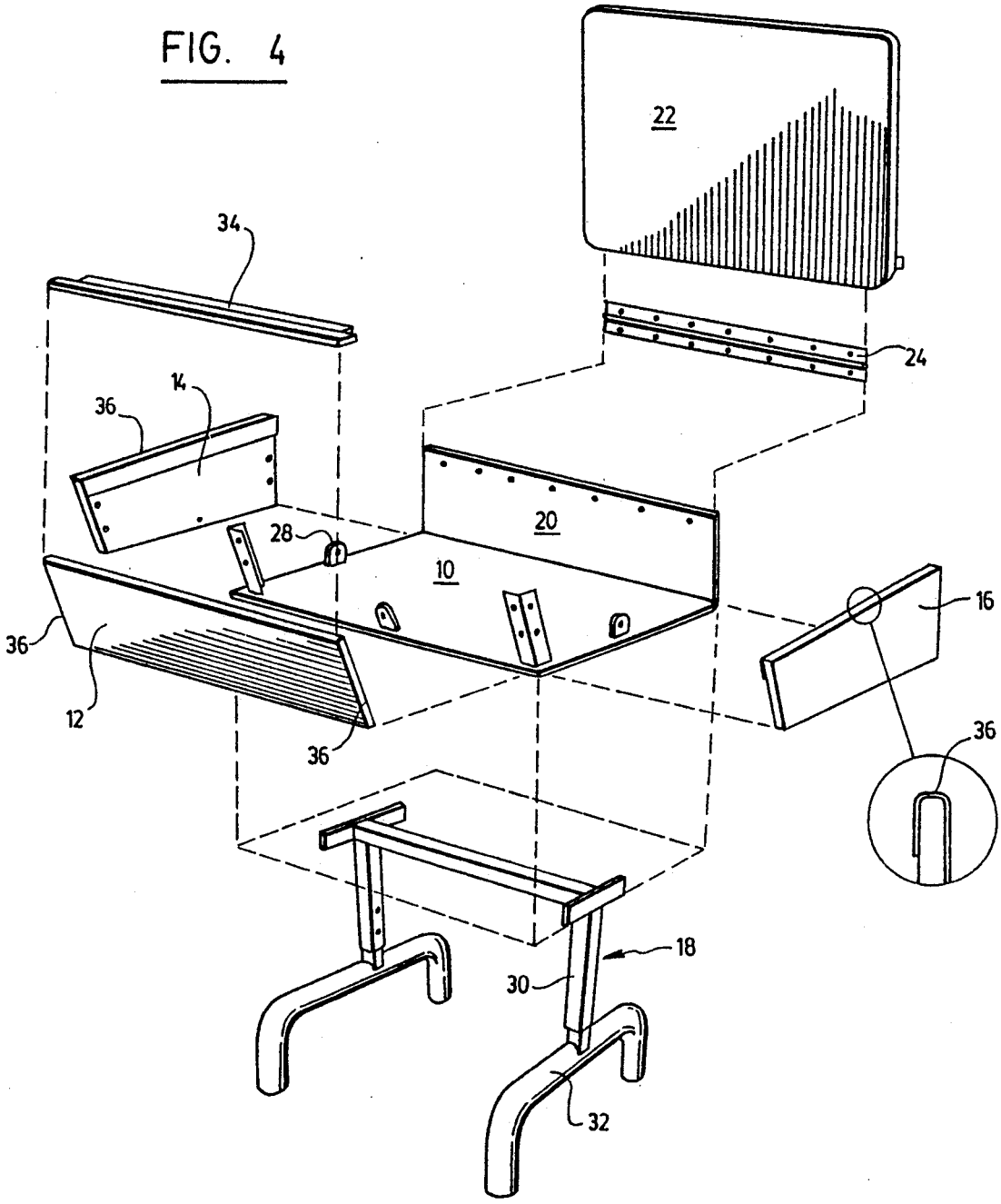
FIG. 4 is an exploded view of an alternative embodiment.

In the alternative embodiment of FIG. 4, rear panel member is formed by a folded extension of base sheet (10), and brackets (26) at the rear are not required. The bottom rear corners of side panels (14) and (16) conform to the bend in sheet (10). The hinge (24) is welded to the metal rear member (20). This embodiment is somewhat less costly to manufacture, however, the appearance from the rear (which is from the front of the classroom) shows some metal.

Of course, the way in which the rear panel is replaced by an extension of the sheet (10) folded upward can also be applied to the front panel member (12). Legs (32) could also be made of wood, if desired, and could comprise four members inserted into four sockets of members (30).

It is to be understood that the above description is not intended to limit the scope of the present invention as defined in the appended claims.

What it claimed is:

1. A desk comprising:

a metal base including leg attachment means and a metal sheet, the sheet providing a bottom of a storage compartment of the desk;

two particle board side panel members having upper, lower, rear and front edges, the lower edge resting on and being protected by said sheet;

a front particle board panel member having a lower edge resting on and being protected by said sheet;

a rear panel member connected to said base and said two side members;

bracket means formed on the metal base for connecting inner sides of said side panel members and said front panel member to said sheet; and a top cover member hingedly connected to said rear member for covering the upper edges of the two side panels and said storage compartment formed by said sheet and said side, front and rear panels.

2. Desk as claimed in claim 1, wherein said side and said front panel members are made of laminated particle board.

3. Desk as claimed in claim 2, wherein said two side panel members are provided with laminate on their exterior sides and on their upper edges, and wherein the front panel member is provided with laminate on its exterior side surface as well as its side edges, the front wood panel covering said front edges of said two side members, and the rear panel covering said rear edges of said two side members.

4. Desk as claimed in claim 3, wherein an upper edge of the front panel member is covered by a pencil trough.

5. Desk as claimed in claim 1, wherein said rear panel member is formed by bending an extension of said sheet upwardly.

6. Desk as claimed in claim 5, wherein an upper edge of the front panel member is covered by a pencil trough.

7. Desk as claimed in claim 1, wherein said leg attachment means comprise a plurality of sockets for receiving leg members.

8. Desk as claimed in claim 1, wherein an upper edge of the front panel member is covered by a pencil trough.

* * * * *